US009169840B2

(12) United States Patent
Yonemoto et al.

(10) Patent No.: US 9,169,840 B2
(45) Date of Patent: Oct. 27, 2015

(54) PISTON OPERATED BYPASS VALVE FOR A SCREW COMPRESSOR

(75) Inventors: Ryuichiro Yonemoto, Shizuoka (JP); Eisuke Kato, Shizuoka (JP); Masayuki Urashin, Shizuoka (JP); Shinichiro Yamada, Yaizu (JP)

(73) Assignee: Hitachi Appliances, Inc., Tokyo (JP)

( * ) Notice: Subject to any disclaimer, the term of this patent is extended or adjusted under 35 U.S.C. 154(b) by 771 days.

(21) Appl. No.: 13/347,214

(22) Filed: Jan. 10, 2012

(65) Prior Publication Data

US 2012/0247139 A1 Oct. 4, 2012

(30) Foreign Application Priority Data

Mar. 30, 2011 (JP) ..... 2011-076611

(51) Int. Cl.
*F04C 28/12* (2006.01)
*F04C 18/16* (2006.01)
*F04C 29/00* (2006.01)

(52) U.S. Cl.
CPC ..... *F04C 28/125* (2013.01); *F04C 18/16* (2013.01); *F04C 28/12* (2013.01); *F04C 29/0007* (2013.01); *F04C 2270/185* (2013.01)

(58) Field of Classification Search
CPC .. F04C 28/12; F04C 18/0207; F04C 29/0007; F04C 2270/185; F04C 2270/18; F04C 2270/021; F04C 2270/213
USPC ..... 417/279, 282, 283, 288, 297, 302, 308, 417/309, 310
See application file for complete search history.

(56) References Cited

U.S. PATENT DOCUMENTS 3,936,239 A * 2/1976 Shaw ..... 417/315
4,249,866 A 2/1981 Shaw et al.
4,335,582 A 6/1982 Shaw et al.
4,412,788 A * 11/1983 Shaw et al. ..... 417/280
4,609,329 A * 9/1986 Pillis et al. ..... 417/282

(Continued)

FOREIGN PATENT DOCUMENTS

EP 1 072 796 A2 1/2001
EP 2 343 457 A1 7/2011

(Continued)

OTHER PUBLICATIONS

Japanese-language Office Action dated May 7, 2013 with partial English translation (Six (6) pages).

(Continued)

*Primary Examiner* — Bryan Lettman
*Assistant Examiner* — Timothy P Solak
(74) *Attorney, Agent, or Firm* — Crowell & Moring LLP

(57) ABSTRACT

A screw compressor includes a valve hole formed at a discharge side end surface of a discharge casing and at a position opening to a compression work chamber; a bypass flow path having the valve hole and a discharge chamber communicate with each other; and a valve body arranged in the valve hole. The screw compressor also includes cylinder chambers provided on a rear surface side of the valve body; a piston reciprocally moving in the cylinder chambers; a rod connecting the piston and the valve body; communication paths for introducing a fluid on a discharge side into the cylinder chamber on a side opposite to a valve body side of the piston and on the valve body side; a pressure discharge path; a plurality of valve means; and a controller controlling the plurality of valves means.

11 Claims, 8 Drawing Sheets

(56) References Cited

U.S. PATENT DOCUMENTS

| | | | | |
|---|---|---|---|---|
| 4,727,725 | A * | 3/1988 | Nagata et al. | 62/196.3 |
| 5,027,608 | A * | 7/1991 | Rentmeester et al. | 62/115 |
| 5,509,273 | A | 4/1996 | Lakowske et al. | |
| 5,979,168 | A * | 11/1999 | Beekman | 62/228.5 |
| 6,276,911 | B1 | 8/2001 | Krusche et al. | |
| 6,517,325 | B2 * | 2/2003 | Tsuru et al. | 417/298 |
| 2008/0038127 | A1 | 2/2008 | Yonemoto et al. | |

FOREIGN PATENT DOCUMENTS

| | | | |
|---|---|---|---|
| JP | 61-79886 | A | 4/1986 |
| JP | 2008-38877 | A | 2/2008 |
| JP | 2010-77897 | A | 4/2010 |
| JP | 2011-58432 | A | 3/2011 |

OTHER PUBLICATIONS

European Search Report dated Nov. 7, 2013 (Six (6) pages).

* cited by examiner

PISTON OPERATED BYPASS VALVE FOR A SCREW COMPRESSOR

BACKGROUND OF THE INVENTION

1. Technical Field of the Invention

The present invention relates to a screw compressor suitable for use in a device, such as an air conditioner, a chiller unit, or a refrigerator, that forms a refrigeration cycle and a chiller unit using same.

2. Description of the Related Arts

In a case where a screw compressor is used for, for example, an air conditioner or a chiller unit, it is used with suction pressure and discharge pressure in a wide range, thus resulting in possibility that pressure in a tooth groove of a screw rotor (pressure of a compression work chamber) becomes higher than discharge pressure under some operation conditions (hereinafter referred to as over-compression). Thus, a screw compressor for reducing over-compression is suggested (for example, see Japanese Patent Application Laid-open No. S61-79886).

The screw compressor described in the Japanese Patent Application Laid-open No. S61-79886 includes: a male rotor (main rotor) and a female rotor (subordinate rotor) rotating while engaging with each other with rotation axes thereof in substantially parallel to each other; bores storing tooth parts of the male rotor and the female rotor; a main casing (housing) having an end surface opening on a discharge side of the bores in a rotor axial direction; and a discharge casing (housing wall) connected to the discharge side of the main casing in the rotor axial direction. The discharge casing has: a discharge side end surface abutting the end surface of the main casing to cover the opening of the bores; an outlet port (discharge window) formed at this discharge side end surface; a discharge chamber where compressed gas is discharged via the outlet port from the compression work chamber formed at tooth grooves of the male rotor and the female rotor; a valve hole opening near the outlet port on the discharge side end surface to at least one of a male rotor side and a female rotor side at a position opposite to a rotor rotation direction; and a bypass flow path having the valve hole and the discharge chamber communicate with each other, and the discharge casing is provided with a valve device (overflow valve) opening and closing the valve hole.

The valve device has: a valve body arranged in the valve hole; and a spring (press spring) biasing the valve body to a main casing side. Then for example, in a case where the valve body is moved to the main casing side to close the valve body, compressed gas is discharged from the compression work chamber to the discharge chamber via the outlet port. On the other hand, in a case where the valve body is moved oppositely to the main casing side to open the valve body, the compressed gas is discharged to the discharge chamber not only via the outlet port but also via the valve hole and the bypass flow path. This reduces over-compression.

As a stopper of the valve body, a step part is formed at the valve body and the valve hole. Consequently, for example, in a case where the valve body has moved to the main casing side, an apical surface of the valve body is on the same plane with respect to the end surface of the discharge casing, which prevents the valve body from contacting with a tooth part end surface of the rotor.

However, it has been found that the following problems need to be improved for the conventional air described above.

Specifically, in the conventional art, pressure from the compression work chamber is acting on the valve body, and thus the compression work chamber turns into an excessively compressed state (pressure of the compression work chamber>pressure of the discharge chamber (discharge pressure), and if it defeats press force of the spring, the valve body is opened. However, when the valve body has opened, pressure of the valve body on a compression work chamber side immediately becomes equal to pressure on a discharge chamber side. On the other hand, back pressure of the valve body is always the pressure of the discharge chamber, and thus pressure acting on the valve body is immediately balanced. Thus, due to the action of the spring biasing the valve body to the main casing side, the valve body is immediately closed. Therefore, in a case where the compression work chamber has turned into the excessively compressed state, the valve body repeats opening and closing at every passage of the compression work chamber through the valve body following rotor rotation, posing a problem that hit sound or vibration caused by hitting the stopper with the valve body occurs.

SUMMARY OF THE INVENTION

It is an object of the present invention to provide a screw compressor capable of reducing hit sound and vibration of a valve body reducing over-compression and a chiller unit using the screw compressor.

To address the problem described above, one aspect of the invention refers to a screw compressor including: a male rotor and a female rotor rotating while engaging with each other with rotation axes thereof in substantially parallel to each other; a main casing having a bore arranging the male rotor and the female rotor; and a discharge casing abutting a discharge side end surface of the main casing in a rotor axial direction to cover an opening of the bore; a discharge chamber or a discharge flow path where compressed gas is discharged from a compression work chamber formed by the male rotor and the female rotor via an outlet port formed in at least one of the main casing and the discharge casing; a valve hole formed near the outlet port at an end surface of the discharge casing on at least one of sides of the male rotor and the female rotor and at a position opening to the compression work chamber; a bypass flow path having the valve hole and the discharge chamber or the discharge flow path communicate with each other; and a valve body arranged in the valve hole. The screw compressor includes: cylinder chambers provided on a rear surface side of the valve body; a piston reciprocally moving in the cylinder chambers; a rod connecting together the piston and the valve body; a communication path for introducing a fluid on a discharge side of the compressor into the cylinder chambers on a side opposite to a valve body side of the piston and on the valve body side; a pressure discharge path for discharging to a suction side of the compressor the fluid introduced into the cylinder chambers on the side opposite to the valve body side of the piston and on the valve body side; a plurality of valve means provided at the pressure discharge path or the communication path, the valve means changing pressure in the cylinder chambers on the side opposite to the valve body side of the piston and on the valve body side; and a controller detecting whether or not over-compression is occurring in the compression work chamber, the controller controlling the plurality of valve means to open the valve body upon detecting the over-compression and close the valve body upon not detecting the over-compression.

Another aspect of the invention refers to a chiller unit formed by connecting together a compressor, an oil separator, a condenser, an expansion valve, and an evaporator with a refrigerant pipe, the chiller unit using the screw compressor described above as the compressor, and including a suction pressure sensor for detecting suction pressure to the compressor and a discharge pressure sensor for detecting discharge pressure from the compressor, wherein the plurality of valve means provided at the screw compressor are respectively formed of electromagnetic valves, and the controller of the screw compressor performs opening and closing control of the magnetic valves based on detection values from the suction pressure sensor and the discharge pressure sensor.

Effects of the Invention

The present invention can provide a screw compressor capable of reducing hit sound and vibration of a valve body reducing over-compression and a chiller unit using the screw compressor.

DETAILED DESCRIPTION OF THE PREFERRED EMBODIMENT

A first embodiment of a screw compressor and a chiller unit using it according to the present invention will be described with reference to FIGS. 1 to 10. In these figures, a portion provided with the same numeral indicates the same or corresponding portion.

First Embodiment

Figure 1:
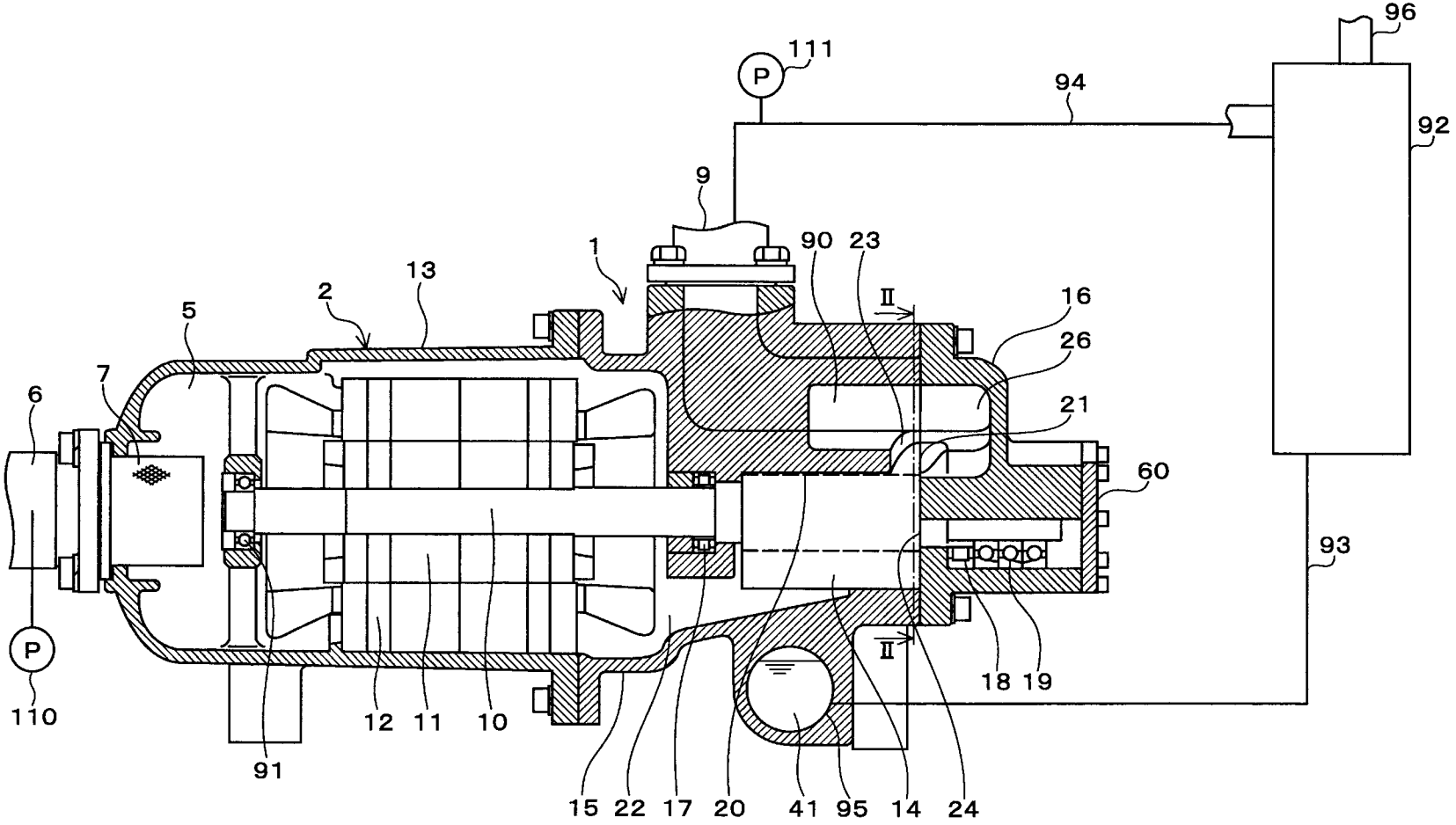
FIG. 1 is a longitudinal sectional view showing a first embodiment of a screw compressor of the present invention.
Figure 2:
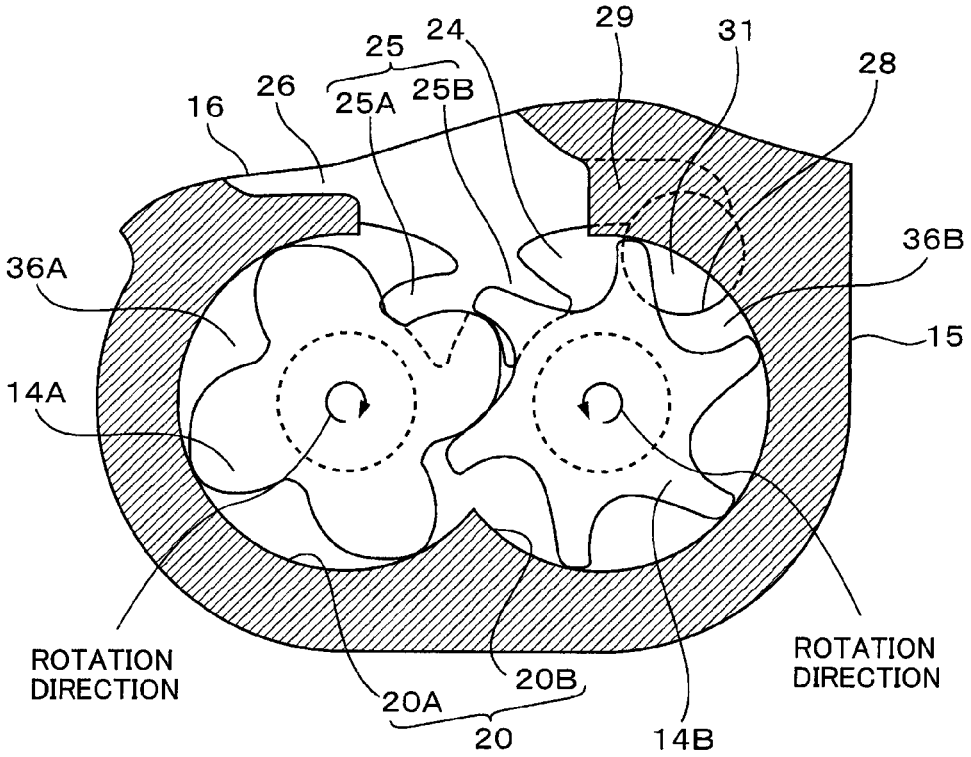
FIG. 2 is a sectional view taken along line II-II of FIG. 1.

FIG. 1 is a longitudinal sectional view showing the first embodiment of the screw compressor according to the invention. FIG. 2 is sectional view taken along line II-II of FIG. 1.

In FIG. 1, the screw compressor includes: a compressor main body 1, a motor (electric motor) 2 driving this compressor main body 1, and a motor casing 13 storing this motor 2. The motor casing 13 has a suction chamber (low pressure chamber) 5 formed on a side opposite to a compressor main body side of the motor 2, and gas flows from an inlet 6 into the suction chamber 5 through a strainer 7. The motor 2 is composed of a rotor 11 fitted to a rotation shaft 10 and a stator 12 provided on an outer periphery side of the rotor 11, and the stator 12 is fixed to an inner surface of the motor casing 13.

The compressor main body 1 is connected to the motor casing 13, and includes: a main casing 15 incorporating a screw rotor 14, and a discharge casing 16 connected to a discharge side of the main casing 15.

Formed at the main casing 15 is a bore 20 of a cylindrical shape storing a tooth section of the screw rotor 14, and a discharge side of the bore 20 in a rotor axial direction is open. On an end surface 21 side of the main casing 15 forming this opening, an radial outlet port 23 is formed in a radial direction, and a discharge flow path 90 connected to the radial outlet port 23 is also formed.

As shown in FIG. 2, the screw rotor 14 is composed of a male rotor 14A and a female rotor 14B engaging with each other with their rotation axes in parallel to each other. Moreover, the bore 20 is composed of a bore 20A arranging the male rotor and a bore 20B arranging the female rotor, and they have compression work chambers 36A and 36B between them and grooves of the male rotor 14A and the female rotor 14B, respectively. The compression work chambers 36A and 36B sequentially change in conjunction with rotation of the screw rotor to: compression chambers in an air suction process communicating with a suction port 22 (see FIG. 1) formed on a suction side (motor casing 13 side) of the main casing 15; compression chambers in a compression process of compressing suctioned gas, and compression chambers in a discharge process of discharging the compressed gas by communicating with axial outlet ports 25 in an axial direction (an axial outlet port 25A on a male rotor side and an axial outlet port 25B on a female rotor side) and the radial outlet port 23 (see FIG. 1) in a radial direction.

The axial outlet ports 25 (25A or 25B) in the axial direction are formed at an end surface 24 of the discharge casing (an end surface 21 side of the main casing) on a axial direction side (front side of FIG. 2) of the male rotor 14A or the female rotor 14B with respect to the compression chambers in the discharge process. Moreover, the radial outlet port 23 in the radial direction is formed on an outer side (top side of FIG. 1) of the male rotor or the female rotor in the radial direction with respect to the compression chambers in the discharge process.

The suction side of the main casing 15 in the rotor axial direction (a left side of FIG. 1) is connected to the motor casing 13, and a space or the like between the rotor 11 and the stator 12 inside the motor casing 13 serves as a suction path having the suction chamber 5 and the compressor main body 1 communicating with each other.

As shown in FIG. 1, a suction side shaft part of the male rotor 14A is supported by a roller bearing 17 provided at the main casing 15 and a ball bearing 91 provided at the motor casing 13, and a discharge side shaft part of the male rotor 14A is supported by a roller bearing 18 and a ball bearing 19 provided at the discharge casing 16. Moreover, a suction side shaft part of the female rotor 14B is supported by a roller bearing (not shown) provided at the main casing 15, and a discharge side shaft part of the female rotor 14B is supported by a roller bearing and a ball bearing (not shown) provided at the discharge casing 16.

Numeral 60 denotes an end cover covering an outer-side end part of a bearing chamber storing the roller bearing 18 and the ball bearing 19, numeral 110 denotes an suction pressure sensor for detecting suction pressure provided at the outlet 6, and numeral 111 denotes a discharge pressure sensor for detecting discharge pressure from a compressor provided at the discharge pipe 94.

The suction side shaft part of the male rotor 14A is directly coupled to the rotation shaft 10 of the motor 2, and the male rotor 14A is rotated by driving of the motor 2, following which the female rotor 14B also rotates while engaging with the male rotor 14A.

Gas compressed by the screw rotors 14 (14A and 14B) flows from the outlet ports 23 and 25 into a discharge chamber 26 formed at the discharge side end surface 24 of the discharge casing 16 or the discharge flow path 90, flows from this discharge flow path 90 to an outlet 9 provided at the main casing 15, and is transmitted to an oil separator 92 through the discharge pipe (refrigerant pipe) 94 connected to the outlet 9. In this oil separator 92, the gas compressed in the compressor main body 1 and oil mixed in this gas are separated. The oil separated by the oil separator 92 is returned through an oil return pipe 93 to an oil tank 95 provided at the bottom of the compressor main body 1, and the oil 41 accumulated here is supplied again to the bearings 17, 18, 19, and 91 supporting the shaft parts of the screw rotors 14 and the rotation shaft 10 of the motor 2 in order to lubricate these bearings.

On the other hand, high-pressure gas whose oil has been separated by the oil separator 92 is supplied through the pipe (refrigerant pipe) 96 to outside (for example, a condenser forming a refrigeration cycle).

The gas suctioned from the inlet 6 to the suction chamber 5, upon passage through inside of the motor casing 13, cools the rotor 11 and the stator 12, then flows through the suction port 22 of the compressor main body 1 to the compression work chambers formed by the screw rotors 14, and following the rotation of the male rotor 14A and the female rotor 14B, the compression work chambers 36A and 36B are reduced in volume while moving in the rotor axial direction, whereby the gas is compressed. The gas compressed in the compression chambers flows to the discharge flow path 90 through the outlet ports 23 and 25 and the discharge chamber 26, and is transmitted from the outlet 9 to the discharge pipe 94.

As shown in FIG. 2, formed at the discharge casing 16 near the axial outlet port 25B on a female rotor 14B side at the discharge side end surface 24 is a valve hole (cylinder) 28 opening at a position opposite (a right side of FIG. 2) to a rotation direction of the female rotor 14*b*, and this valve hole 28 is configured to open to the compression work chamber 36B formed by the female rotor 14B and the bore 20B. Moreover, formed at the valve hole 28 is a valve body 31 for opening and closing the valve hole 28.

Moreover, formed at the discharge casing 16 is a bypass 29 which is located on an outer side in a rotor radial direction than an opening edge of the bore 20B on the female rotor 14B side at the end surface 21 of the main casing 15 and which have the valve hole 28 and the discharge chamber 26 communicate with each other, and the bypass 29 and the end surface 21 of the main casing 15 covering this form a bypass flow path.

Figure 3:
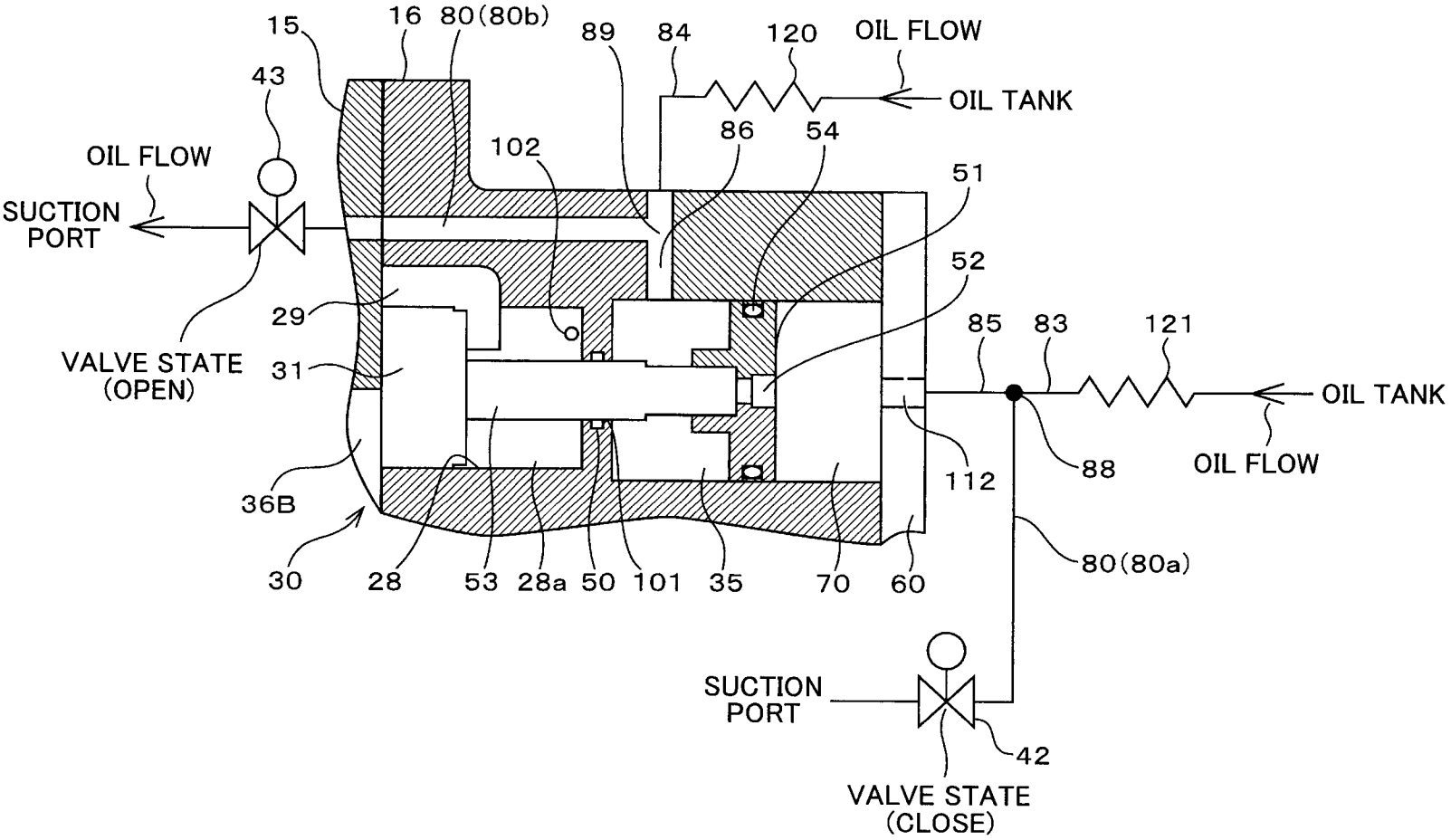
FIG. 3 is a sectional view of main parts of a valve body driving device unit according to the first embodiment of the invention, showing that a value body is in a closed state.
Figure 4:
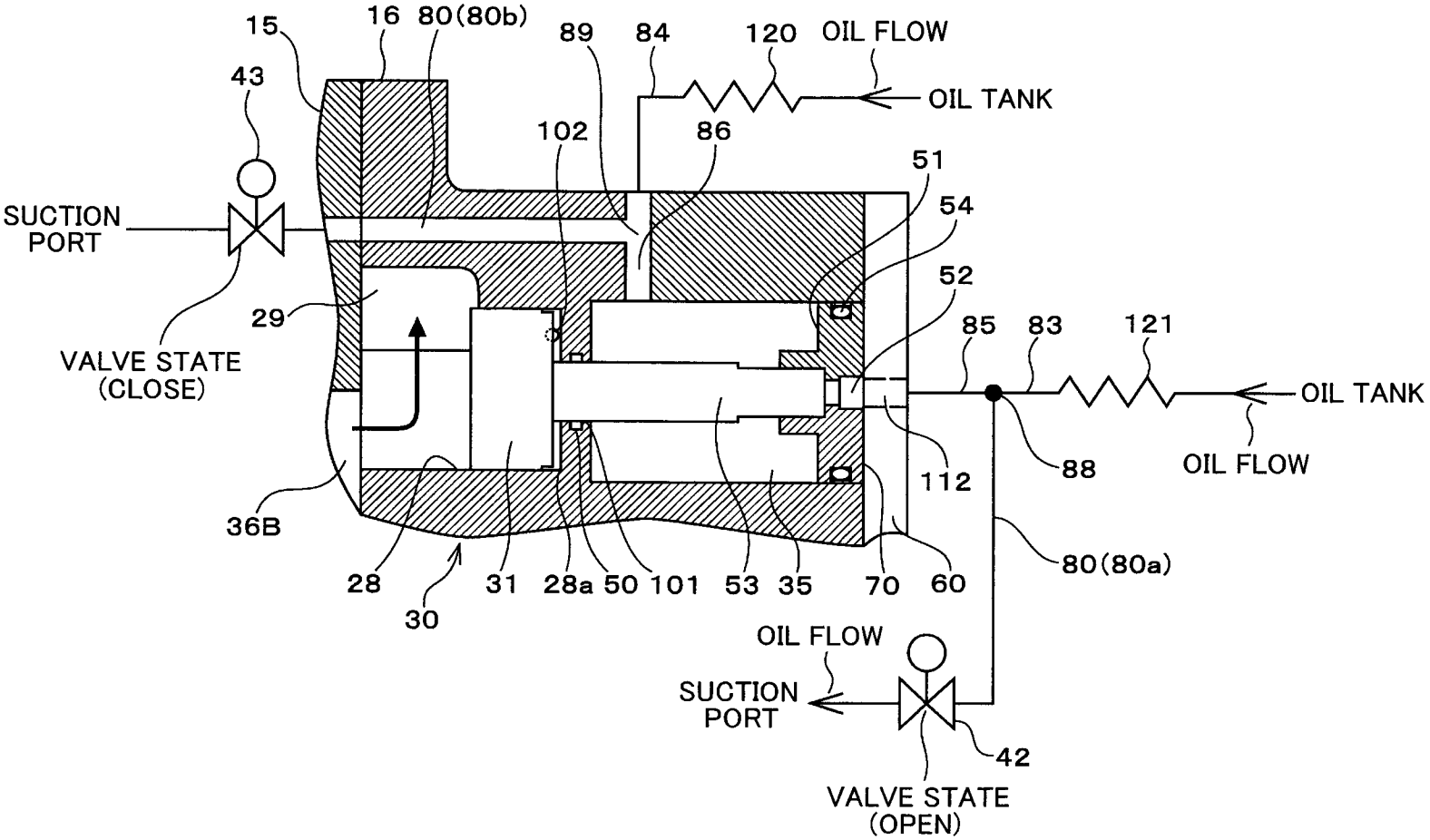
FIG. 4 is a sectional view of the main parts of the valve body driving device unit according to the first embodiment of the invention, showing that the value body is in an open state.
Figure 5:
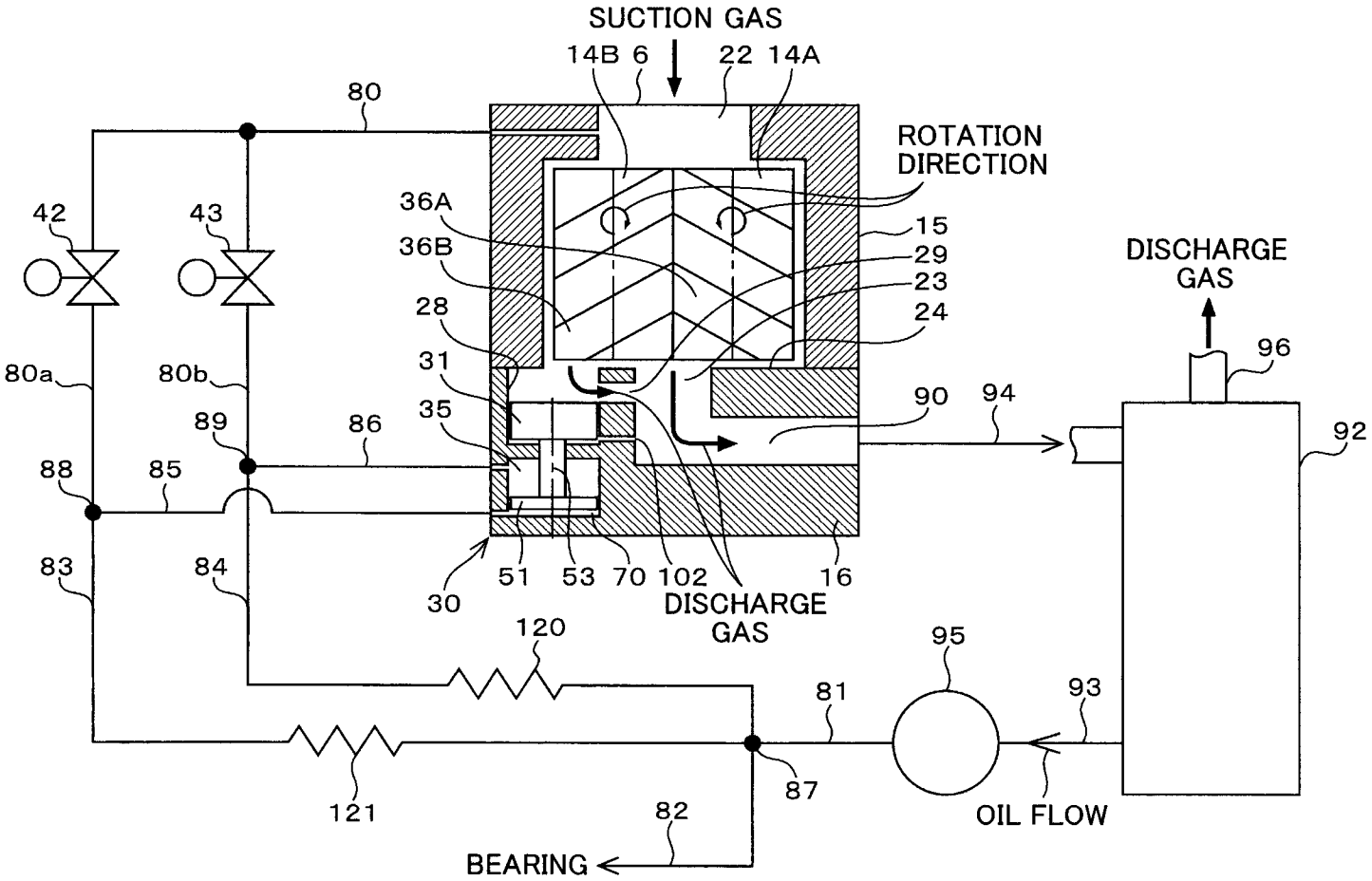
FIG. 5 is a systematic diagram illustrating overall configuration of the valve body driving device according to the first embodiment of the invention.
Figure 6:
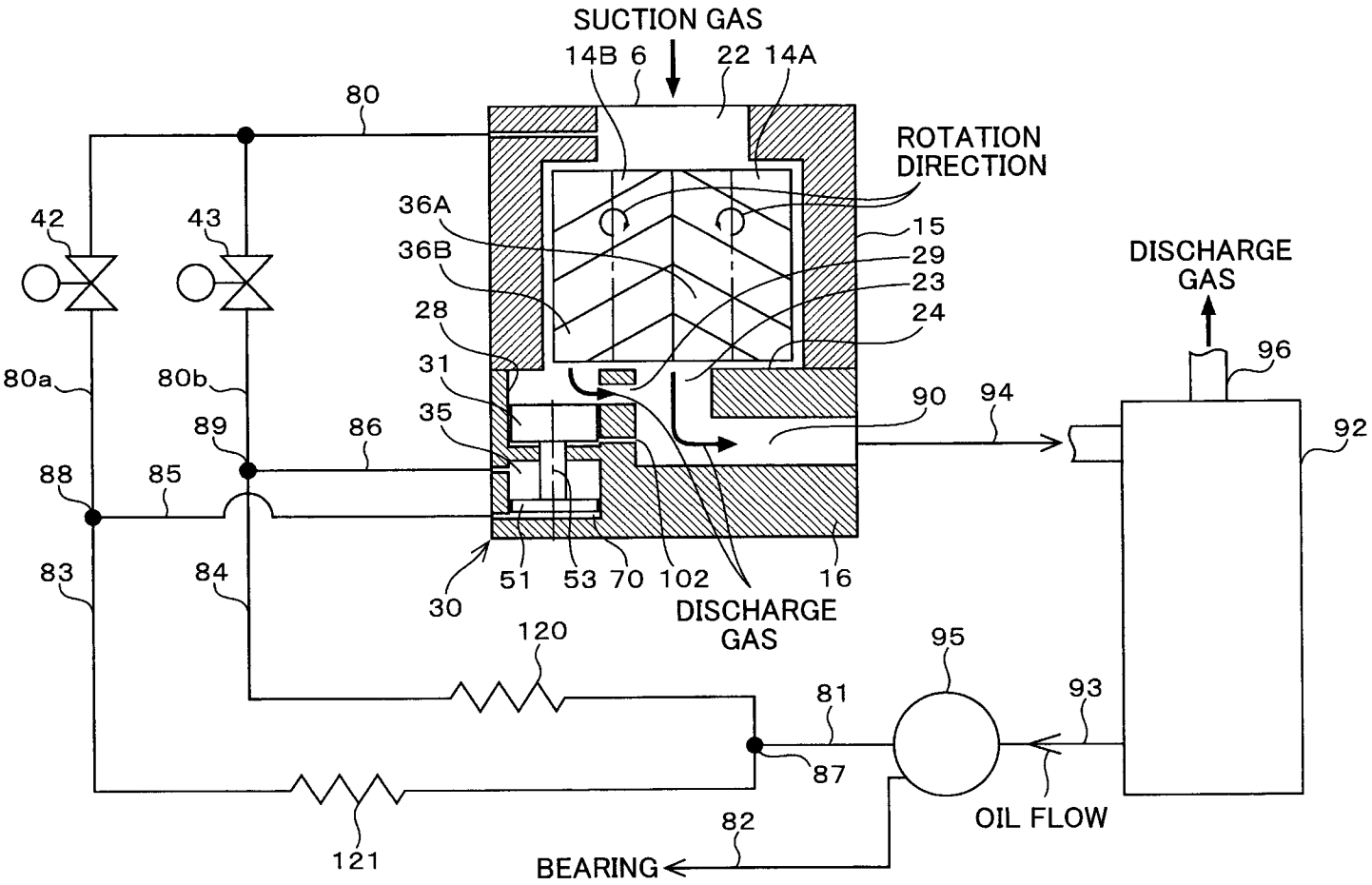
FIG. 6 is a systematic diagram illustrating overall configuration showing another example of the valve body driving device according to the first embodiment of the invention.

Next, configuration of a valve body driving device part 30 for driving the valve body 31 will be described with reference to FIGS. 3 to 6. FIGS. 3 and 4 are sectional views of main parts of the valve body driving device part 30, with FIG. 3 showing that the valve body 31 is in a closed state and FIG. 4 showing that the valve body 31 is in an open state. FIG. 5 is a systematic diagram illustrating overall configuration of the valve body driving device, and FIG. 6 is also a systematic diagram similar to FIG. 5, showing a partially modified example of FIG. 5.

In FIGS. 3 and 4, the valve body driving device part 30 includes: a rod 53 whose one end is connected to a rear surface of the valve body 31 provided in such a manner as to be capable of sliding and reciprocally moving in the valve hole 28; a piston 51 connected to the other end side of the rod 53 via a bolt 52; and cylinder chambers 35 and 70 storing the piston 51 in a slidable manner. The cylinder chambers 35 and 70 are formed in the discharge casing 16, in which a rod hole 101 slidably supporting the rod 53 is provided. Moreover, the rod hole 101 is provided with a seal ring 50, which is adapted to seal a space between inside of the cylinder chamber 35 and a back pressure chamber 28*a* of the valve body 31.

To the back pressure chamber 28*a*, pressure on a discharge side of the compressor is introduced through a communication hole 102 formed at the discharge casing 16. That is, one end side of the communication hole 102 is open to the back pressure chamber 28*a*, and the other end side of the communication hole 102 communicates with the discharge chamber 26 (see FIG. 1).

Fitted to outer periphery of the piston 51 is a seal ring 54 for preventing leakage between the cylinder chambers 35 and 70 formed on both sides of the piston 51.

At a portion outside of a moving range of the piston 51 in the cylinder chamber 70 (cylinder chamber on aside opposite to a valve body side), one end of a first communication path (feed and exhaust path) 85 is open. Specifically, an outer-side end part of the cylinder chamber 70 is covered by the end cover 60, at which a communication hole 112 is formed, and to this communication hole 112, one end of the communication path 85 is connected. The other end side of this communication path 85 is connected to a first communication path (pressure supply path) 83 having a capillary tube 121, and the other end side of a first communication path 83 communicates with the oil tank 95 shown in FIG. 1.

Moreover, a portion (branch part 88) of the first communication path 83 downstream of the capillary tube 121 is also configured to communicate with a low-pressure space of, for example, the suction port 22 (see FIG. 1) via a first pressure discharge path 80 (80*a*). In midstream of the pressure discharge path 80*a*, a electromagnetic valve (first valve means) 42 for opening and closing the pressure discharge path 80*a* is provided, and opening and closing of the electromagnetic valve 42 permits high-pressure oil of the oil tank 95 to be introduced to the cylinder chamber 70 or permits the oil of the cylinder chamber 70 to be discharged to a suction port 22 side via the first pressure discharge path 80 (80*a*) and the electromagnetic valve 42, so that the pressure of the cylinder chamber 70 can be changed.

At a portion (left end side of the cylinder chamber 35) outside of the moving range of the piston 51 in the cylinder chamber 35 (cylinder chamber on the valve body side), one end of a second communication path (feed and exhaust path) 86 opens, and the other end side of this communication path 86 is connected to a first communication path (pressure feed path) 84 having a capillary tube 120, and the other end side of this communication path 84 communicates with the oil tank 95.

Moreover, a portion (branch part 89) of a second communication path 84 downstream of the main body frame 120 is configured to communicate with a low-pressure space of, for example, the suction port 22 via a second pressure discharge path 80 (80*b*). In midstream of the second pressure discharge path 80*b*, an electromagnetic valve 43 for opening and closing the second pressure discharge path 80*b* is provided, and opening and closing of the electromagnetic valve 43 permits the high-pressure oil of the oil tank 95 to be introduced to the cylinder chamber 35 and the oil of the cylinder chamber 35 to be discharged to the suction port 22 side via the communication path 86, the second pressure discharge path 80 (80*b*), and the electromagnetic valve 43, so that the pressure of the cylinder chamber 35 can be changed.

FIGS. 5 and 6 are systematic diagrams illustrating overall configuration of the valve body driving device according to this embodiment. In FIGS. 5 and 6, portions provided with the same numerals as those of FIGS. 1 to 4 indicate the same or corresponding portions.

First, the systematic diagram of FIG. 5 will be described. The oil separated by the oil separator 92 passes through the oil return pipe 93 and enters into the oil tank 95 formed at the main casing 15 of the compressor (see FIG. 1). This oil of the oil tank 95 serves almost discharge pressure and is taken out from another oil return pipe 81, and at a branch part 87, branching occurs to an oil feed path 82 for each of the bearings, the first communication path 83 for supplying pressure oil to the cylinder chamber 70 of the valve body driving device part 30, and the second communication path 84 for supplying the pressure oil to the cylinder chamber 35 of the valve body driving device part 30. The communication paths (pressure supply paths) 83 and 84 are provided with the capillary tubes 121 and 120, respectively, and a downstream side of the first communication path 83 branches at a branch part 88 to the first communication path (feed and exhaust path) 85 connected to the cylinder chamber 70 and the first pressure discharge path 80*a* connected to the suction port 22, and this first pressure discharge path 80*a* is provided with the electromagnetic valve 42.

Similarly, a downstream side of the second communication path 84 branches at the branch part 89 to the second communication path (feed and exhaust path) 86 connected to the cylinder chamber 35 and the second pressure discharge path 80*b* connected to the suction port 22, and this second pressure discharge path 80*b* is also provided with the electromagnetic valve 43.

The downstream sides of the first and second pressure discharge paths 80*a* and 80*b* merge into one pressure discharge path 80, which is connected to the suction port 22.

At the oil feed path 82 for the bearing, oil always flows for the purpose of oil feed to the bearing. Therefore, pressure loss occurs at the oil return pipe 81, which reduces pressures of the cylinder chambers 35 and 70 by a degree corresponding to the pressure loss. To avoid the occurrence of the pressure loss at the oil return pipe 81, the oil feed path 82 and the first and second communication paths 83 and 84 may not share the oil return pipe 81, and as shown in FIG. 6, pressure oil may be independently taken out from the oil tank 95 for the oil feed path 82. This permits flow of a small amount of oil to each of the communication paths 83 and 84, which can almost zero the pressure loss at the oil return pipe 81. In FIG. 6, other configuration is the same as that of FIG. 5.

In the embodiment shown in FIGS. 1 to 6, the oil tank 95 is integrally formed with the main casing 15, and forming the pressure discharge paths 80, 80*a*, and 80*b*, the communication paths 83 to 86, and the oil feed path 82 integrally built in the main casing 15 can reduce the pipes around the compressor. The capillary tubes 120 and 121 and the electromagnetic valves 42 and 43 may also be set at outer periphery of the casing.

Next, control of the valve body 31 will be described with reference to FIGS. 3, 4, and 5 described above.

The valve body 31 is controlled to close when over-compression is not occurring in the compression work chambers 36A and 36B and controlled to open when the over-compression is occurring there.

To control the valve body 31 to close it, the electromagnetic valve 42 is turned into a closed state and the electromagnetic valve 43 is turned into an open state. Consequently, the oil of the cylinder chamber 35 is discharged to the suction port 22 side via the second communication path (feed and exhaust path) 86 and the pressure discharge paths 80*b* and 80, and the cylinder chamber 35 consequently has low pressure. On the other hand, to the cylinder chamber 70, the high pressure oil of the oil tank 95 is introduced via the capillary tube 121 and the first communication paths 83 and 85, and pressure of the cylinder chamber 70 is filled with high pressure (≈Pd), and thus as shown in FIG. 3, the valve body 31 is pressed against the valve hole 28 to close the valve hole 28.

At this point, the second communication path 84 provided with the capillary tube 120 and the pressure discharge paths 80*b* and 80 sides communicate with the suction port 22, but oil flow is narrowed down by the main body frame 120, so that the amount of oil discharged from the oil tank 95 to the suction port 22 can be sufficiently small. Therefore, gas (for example, refrigerant gas) suctioned to the compressor and heated by the oil is sufficiently reduced to suppress deterioration in volumetric efficiency.

Moreover, since the oil is discharged to the suction port 22 in this embodiment, a period for which the refrigerant gas suctioned to the compressor is heated by the oil can be minimized, and also in this point, the refrigerant gas heated by the oil can be reduced, which can therefore suppress the deterioration in the volumetric efficiency.

In a case where over-compression has occurred in the compression work chambers 36A and 36B, the valve body 31 is controlled to open. In this case, the electromagnetic valve 42 is turned into an open state and the electromagnetic valve 43 is turned into a closed state. This introduces the high pressure oil of the oil tank 95 to the cylinder chamber 35 via the capillary tube 120 and the second communication paths 84 and 86, so that the pressure of the cylinder chamber 35 turns into high pressure (≈Pd). On the other hand, the oil of the cylinder chamber 70 is discharged to the suction port 22 via the first communication path (feed and exhaust path) 85 and the pressure discharge paths 80*a* and 80. Therefore, as shown in FIG. 4, the piston 51 moves towards the end cover 60, and the valve body 31 separates from the main casing 15, whereby the valve hole 28 is opened.

In the embodiment above, as shown in FIGS. 3 to 6, an example where the first and second communication paths 83 and 84 are provided with the capillary tubes 120 and 121 has been described, but a throttle or an electromagnetic valve may be provided in place of the capillary tubes 120 and 121 in such a manner as to oppositely move in conjunction with the opening and closing of the electromagnetic valves 42 and 42. Providing the electromagnetic valves in place of the capillary tubes 120 and 121 can zero the amount of oil flowing to the suction port 22 side.

Further, reversing set positions of the electromagnetic valve 42 and the capillary tube 121 or set positions of the electromagnetic valve 43 and the capillary tube 120 also makes it possible to perform opening and closing control of the valve body 31.

Figure 7:
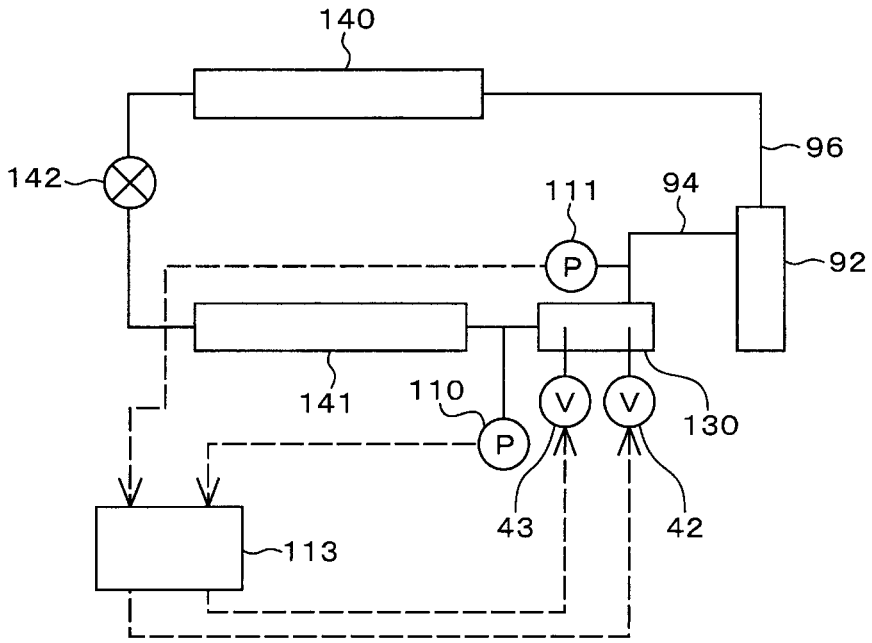
FIG. 7 is a refrigeration cycle configuration diagram showing one example of a chiller unit using a screw compressor shown in the first embodiment of the invention.

FIG. 7 is a refrigeration cycle configuration diagram showing one example of a chiller unit using the screw compressor described above. A structure of the valve body driving device for driving the valve body 31 to open and close has been described with reference to FIGS. 3 to 6, but a controller controlling the electromagnetic valves 42 and 43 forming the valve driving device will be described with reference to FIG. 7.

First, configuration of the chiller unit shown in FIG. 7 will be described. The chiller unit is composed of: a screw compressor (compressor) 130 (corresponding to the screw compressor shown in FIG. 1) connected with a sequential refrigerant pipe 96; the oil separator 92, a condenser 140, an electronic expansion valve (expansion valve) 142, an evaporator 141; etc. An outlet of the screw compressor 130 is connected to the oil separator 92 via the discharge pipe 94, the discharge pipe is provided with a discharge pressure sensor 111 for detecting discharge side pressure of the compressor, and on a suction side of the compressor, a suction pressure sensor 110 is provided. Numerals 42 and 43 denote electromagnetic valves forming the valve body driving device, and are identical to the electromagnetic valves 42 and 43 shown in FIGS. 3 to 6. Numeral 113 denotes a controller obtaining a pressure ratio during operation based on detection values of the suction pressure sensor 110 and the discharge pressure sensor 111, judging whether or not over-compression is occurring, and controlling the electromagnetic valves 42 and 43.

The control by the controller 113 will be described in detail.

Signals from the pressure sensors 110 and 111 are transmitted to the controller 113. In the controller 113, based on the signals from the pressure sensors 110 and 111, a pressure ratio (between discharge pressure and suction pressure) during operation at this point is calculated. Moreover, the controller 113 previously stores a preset pressure ratio, and it is compared with the pressure ratio during operation calculated above.

As a result of this comparison, if the calculated pressure ratio during operation is equal to or higher than the preset pressure ratio, it is judged that over-compression is not occurring in the compression work chambers 36A and 36B, and control is performed to turn the electromagnetic valve 42 into a closed state and turn the electromagnetic valve 43 into an open state. Consequently, as shown in FIG. 3, the valve body 31 moves towards the main casing 15 and thus is pressed, whereby the valve hole 28 is closed.

On the other hand, if the calculated pressure ratio during operation is lower than the preset pressure ratio, it is judged that over-compression is occurring in the compression work chambers 36A and 36B, and control is performed to turn the electromagnetic valve 42 into an open state and turn the electromagnetic valve 43 into a closed state. Consequently, as shown in FIG. 4, control is made to move the valve body 31 oppositely (rightward in FIG. 4) to the main casing 15 to open the valve hole 28. Thus, compressed gas of the compression work chambers 36A and 36B are discharged from the valve hole 28 to the discharge chamber 26 (see FIG. 2) via the bypass flow path (the bypass) 29 (see FIGS. 4 and 5), and thus the pressure of the compression work chambers 36A and 36B is reduced until almost reaching the pressure of the discharge chamber 26. Therefore, over-compression in the compression work chambers 36A and 36B can be reduced, thus suppressing unnecessary power consumption.

Next, relationship between a degree of oil pressure introduced to the cylinder chambers 35 and 70 and driving force in the valve body driving device part 30 will be described with reference to FIG. 5 above and FIGS. 8 to 10.

When the electromagnetic valves 42 and 43 are closed, the oil pressure (pressure) in the cylinder chambers 35 and 70 becomes substantially equal to the discharge pressure Pd of discharged refrigerant gas immediately after discharge from the compressor.

However, an increase in rotor rotation speed and an increase in the amount of discharge causes pressure loss C immediately after the compressor discharge to the oil separator 92 and pressure loss B from the oil separator 92 to the branch point 87, causing pressure loss D obtained by adding up these types of pressure loss B and C. This pressure loss D increases with an increase in the number of rotations of the compressor.

Figure 8:
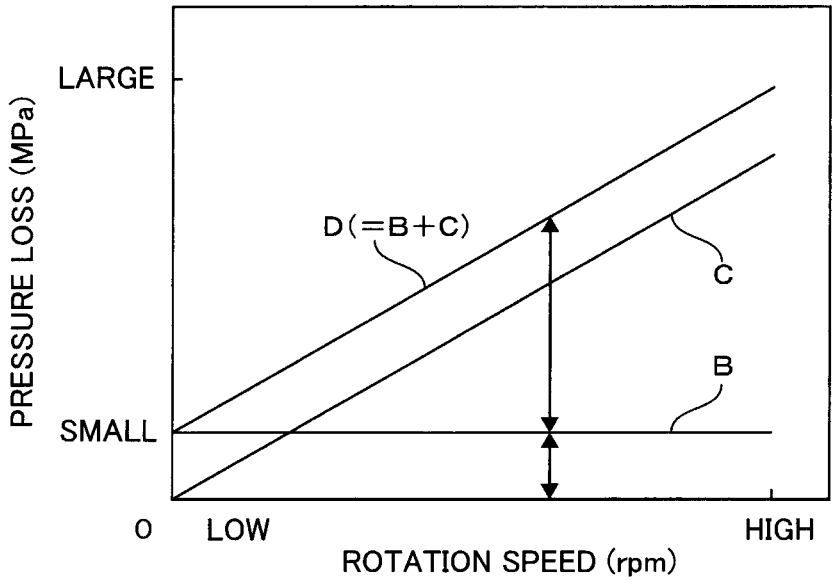
FIG. 8 is a line diagram illustrating rotation speed and pressure loss of a discharge pipe, etc. in the screw compressor.
Figure 9:
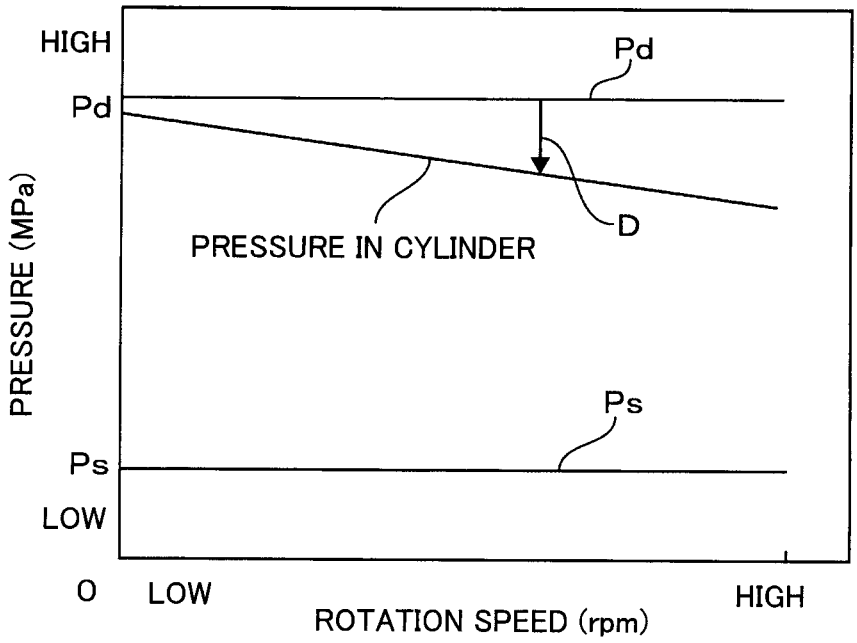
FIG. 9 is a line diagram illustrating relationship between the rotation speed and pressure of each part in the screw compressor.

Thus, as shown in FIG. 9, even when the electromagnetic valves 42 and 43 have been closed, the pressure in the cylinder chambers 35 and 70 drops by the pressure loss D shown in FIG. 8 with respect to the discharge pressure Pd. In FIG. 9, Ps denotes suction pressure of refrigerant gas suctioned to the compressor.

Even more detailed description will be given.

As shown in FIG. 3, to close the valve body 31, the electromagnetic valve 42 is turned into a closed state and the electromagnetic valve 43 is turned into an open state. Consequently, the cylinder chamber 35 communicates with the suction port 22 side via the second communication path (feed and exhaust path) 86 and the second pressure discharge paths 80*b* and 80, and thus consequently has low pressure (suction pressure Ps shown in FIG. 9). On the other hand, for the cylinder chamber 70, the high pressure oil of the oil tank 95 is introduced to the cylinder chamber 70 via the first communication path (pressure supply path) 83 having the capillary tube 121 and the first communication path 85, and the pressure of the cylinder chamber 70 turns into pressure (Pd−D) obtained by subtracting the pressure loss D (see FIG. 7) from the discharge pressure Pd. Therefore, differential pressure "(Pd−D)−PS" acts on the piston 51, and thus as shown in FIG. 3, the valve hole 28 is closed.

As shown in FIG. 4, to open the valve body 31, the electromagnetic valve 42 is turned into an open state and the electromagnetic valve 43 is turned into a closed state. Consequently, to the cylinder chamber 35, the high pressure oil of the oil tank 95 is introduced via the second communication path (pressure supply path) 84 having the capillary tube 120 and the second communication path 86, and the pressure of the cylinder chamber 35 turns into pressure (Pd−D) obtained by subtracting the pressure loss D (see FIG. 7) from the discharge pressure Pd. On the other hand, the cylinder chamber 70 communicates with the suction port 22 side via the second communication path (feed and exhaust path 85 and the first pressure discharge paths 80*a* and 80, and thus has low pressure (suction pressure Ps shown in FIG. 9). Therefore, differential pressure "(Pd−D)−PS" acts on the piston 51*n* a direction opposite to that in a case where the valve body 31 described above is closed, and thus as shown in FIG. 4, the valve body 31 moves to open the valve hole 28.

Figure 10:
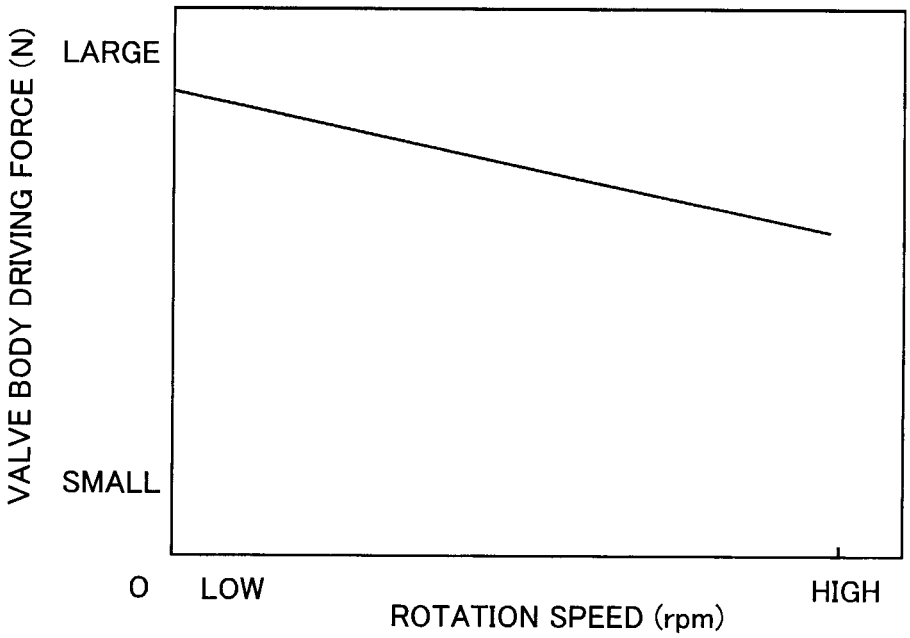
FIG. 10 is a line diagram illustrating the rotation speed and driving force of the valve body in the screw compressor.

FIG. 10 is a line diagram showing force of driving the valve body 31 (over-compression preventing valve) 31 described above. The driving force of the valve body 31 is generated by difference between the pressure inside the cylinder chamber 35 and the pressure inside the cylinder chamber 70, but pressure of the high pressure oil supplied to the cylinder chamber decreases with an increase in the rotation speed. Thus, as shown in FIG. 10, the driving force of the valve body 31 decreases with an increase in the rotation speed, but providing the configuration of this embodiment can provide sufficient valve body driving force even when the rotation speed has increased, which can reliably drive the valve body.

Moreover, in the example shown in FIG. 5, the pressure supply paths (first and second communication paths) 83 and 84 provided with the capillary tubes branch at the branch part 87 from the oil feed path 82, but directly connecting the pressure supply paths 83 and 84 to the oil tank 95 as shown in FIG. 6 can reduces pressure loss of the pressure oil supplied to the cylinder chambers 35 and 70, which can therefore increase the driving force of the valve body 31, making it possible to reliably further drive the valve body 31.

In a conventional screw compressor as described in the Japanese Patent Application Laid-open No. S61-79886 described above, a spring is provided on a back pressure side of a valve body, and the valve body is opened and closed by extracting and contracting action of this spring, but the spring is required and also it is difficult to adjust spring strength. Further, there also arise problems with spring durability, valve body vibration and hit sound.

On the contrary, the embodiment of the invention described above provides configuration such that pressure on a compressor high pressure side can be introduced into the cylinder chambers on both sides of the piston directly connected to the valve body, and utilizing a pressure difference from the suction side, the pressure of the cylinder chambers on the both sides of the piston is changed to move the piston based on the pressure difference. Therefore, by the valve body directly connected to the piston, the valve hole can be controlled to completely open or close, and thus a spring as required in conventional art is no longer required and also vibration of the valve body can be prevented. Further, the case where a fluid flowing into or out of the cylinder chambers (a case where it is defined as oil from the oil tank in the embodiment described above, but compressed gas on the discharge side may be introduced) can slow movement of the valve body with the capillary tubes serving as a resistor, eliminating the hit sound of the valve body and also ensuring work of the valve body.

As described above, this embodiment can provide a screw compressor capable of reducing hit sound and vibration of the valve body which reduces over-compression and a chiller unit using the screw compressor, and further can reliably open and close the valve body regardless of compressor operation pressure condition and the rotor rotation speed, which can reduce over-compression, achieving performance improvement.

What is claimed is:

1. A screw compressor including:

a male rotor and a female rotor rotating while engaging with each other with rotation axes thereof that are substantially parallel to each other; a main casing having a bore arranging the male rotor and the female rotor; and a discharge casing abutting a discharge side end surface of the main casing in a rotor axial direction to cover an opening of the bore; a discharge chamber or a discharge flow path where compressed gas is discharged from a compression work chamber formed by the male rotor and the female rotor via an outlet port formed in at least one of the main casing and the discharge casing; a valve hole formed near the outlet port at an end surface of the discharge casing on at least one of sides of the male rotor and the female rotor and at a position opening to the compression work chamber; a bypass flow path having the valve hole and the discharge chamber or the discharge flow path communicate with each other; and a valve body arranged in the valve hole, the screw compressor comprising:

cylinder chambers provided on a rear surface side of the valve body;

a piston reciprocally moving in the cylinder chambers;

a rod connecting together the piston and the valve body;

a communication path for introducing a fluid on a discharge side of the compressor into the cylinder chambers on a side opposite to a valve body side of the piston and on the valve body side;

a pressure discharge path for discharging to a suction side of the compressor the fluid introduced into the cylinder chambers on the side opposite to the valve body side of the piston and on the valve body side;

a plurality of valve means provided at the pressure discharge path or the communication path, the valve means changing pressure in the cylinder chambers on the side opposite to the valve body side of the piston and on the valve body side; and a controller detecting whether or not over-compression is occurring in the compression work chamber, the controller controlling the plurality of valve means to open the valve body upon detecting the over-compression and close the valve body upon not detecting the over-compression;

wherein the communication path includes a first communication path connecting together inside of the cylinder chamber on the side opposite to the valve body side of the piston and the discharge side of the compressor and a second communication path connecting together inside of the cylinder chamber on the valve body side of the piston and the discharge side of the compressor;

wherein the pressure discharge path includes a first pressure discharge path connecting together the inside of the cylinder chamber on the side opposite to the valve body side of the piston and a low pressure space of the compressor and a second pressure discharge path connecting together the inside of the cylinder chamber on the valve body side of the piston and the low pressure space of the compressor;

wherein the plurality of valve means includes a first valve means provided at the first pressure discharge path for opening and closing the pressure discharge path and a second valve means provided at the second pressure discharge path for opening and closing the pressure discharge path;

wherein the controller controls the first and second valve means to open the valve body upon detecting the occurrence of the over-compression and close the valve body upon not detecting the occurrence of the over-compression; and wherein the controller obtains a pressure ratio during operation based on suction pressure to the compressor and discharge pressure of the compressor, compares the pressure ratio with a set pressure ratio previously stored, judges that the over-compression has occurred when the pressure ratio during operation has become smaller than the set pressure ratio, and controls the first and second valve means to open the valve body.

2. The screw compressor according to claim 1, wherein the controller performs control to open the first valve means and close the second valve means upon judging that the over-compression has occurred and performs control to close the first valve means and open the second valve means upon judging that the over-compression has not occurred.

3. The screw compressor according to claim 2, further comprising:

a suction pressure sensor for detecting suction pressure; and a discharge pressure sensor for detecting discharge pressure.

4. The screw compressor according to claim 3, wherein the first and second communication paths connecting together the discharge side of the compressor and the inside of the cylinder chambers are each composed of a pressure supply path for supplying discharge side pressure to the cylinder chamber and a feed and exhaust path for feeding and exhausting the pressure to the cylinder chamber, and the pressure supply paths in the first and second communication paths are provided with capillary tubes, respectively.

5. The screw compressor according to claim 4, wherein upstream sides of the first and second communication paths connected to the inside of the cylinder chambers are connected to an oil tank communicating with the discharge side of the compressor.

6. The screw compressor according to claim 1, wherein the first and second valve means provided at the first and second pressure discharge paths are electromagnetic valves.

7. The screw compressor according to claim 1, wherein the first and second communication paths connected to the inside of the cylinder chambers are respectively open to the inside of the cylinder chambers outside of a moving range of the piston, and the pressure discharge path connected to the low pressure space opens to a suction port.

8. The screw compressor according to claim 1, wherein the first pressure discharge path connects together midstream of the first communication path and the low pressure space of the compressor, and the second pressure discharge path connects together midstream of the second communication path and the low pressure space of the compressor.

9. The screw compressor according to claim 1, comprising:

a first communication path connecting together inside of the cylinder chamber on the side opposite to the valve body side of the piston and the discharge side of the compressor; a first pressure discharge path connecting together the inside of the cylinder chamber on the side opposite to the valve body side of the piston and a low pressure space of the compressor; a first valve means provided at the first communication path for opening and closing the communication path; and a capillary tube or a throttle provided at the first pressure discharge path;

a second communication path connecting together inside of the cylinder chamber on the valve body side of the piston and the discharge side of the compressor; a second pressure discharge path connecting together the inside of the cylinder chamber on the valve body side of the piston and the low pressure space of the compressor; a second valve means provided at the second communication path for opening and closing the communication path; and a capillary tube or a throttle provided at the second pressure discharge path, wherein the controller detects whether or not the over-compression is occurring in the compression work chamber, and controls the first and second valve means to open the valve body upon detecting the occurrence of the over-compression and close the valve body upon not detecting the occurrence of the over-compression.

10. A chiller unit formed by connecting together a compressor, an oil separator, a condenser, an expansion valve, and an evaporator with a refrigerant pipe, the chiller unit using the screw compressor according to claim 1 as the compressor, and comprising a suction pressure sensor for detecting suction pressure to the compressor and a discharge pressure sensor for detecting discharge pressure from the compressor, wherein the plurality of valve means provided at the screw compressor are respectively formed of electromagnetic valves, and the controller of the screw compressor performs opening and closing control of the magnetic valves based on detection values from the suction pressure sensor and the discharge pressure sensor.

11. The chiller unit using a screw compressor according to claim 10, wherein the controller obtains a pressure ratio during operation based on the suction pressure to the compressor and the discharge pressure from the compressor, compares the pressure ratio with a set pressure ratio previously stored, and when the pressure ratio during operation is smaller than the set pressure ratio, performs opening and closing control of the plurality of electromagnetic valves provided at the screw compressor in order to open the valve body provided at the screw compressor.

* * * * *